US005613175A

United States Patent [19]

Frankel

[11] Patent Number: 5,613,175

[45] Date of Patent: Mar. 18, 1997

[54] ANISOTROPIC IMAGING MEMBER

[75] Inventor: Neil A. Frankel, Rochester, N.Y.

[73] Assignee: Xerox Corporation, Stamford, Conn.

[21] Appl. No.: 521,781

[22] Filed: Aug. 31, 1995

[51] Int. Cl.[6] ..... G03G 15/00

[52] U.S. Cl. ..... 399/162; 399/159

[58] Field of Search ..... 355/200, 210, 355/211, 212, 213, 326 R; 430/270.1, 271.1

[56] References Cited

U.S. PATENT DOCUMENTS

| | | | |
|---|---|---|---|
| 4,225,508 | 3/1981 | Kuehnle | 355/211 X |
| 4,233,383 | 11/1980 | Horgan | 430/58 |
| 4,258,113 | 3/1981 | Kuehnle | 355/211 X |
| 4,329,043 | 5/1982 | Kuehnle | 355/211 X |
| 4,883,742 | 11/1989 | Wallbillich et al. | 430/270.1 X |
| 5,006,899 | 4/1991 | Bujese | 355/326 R X |
| 5,262,826 | 11/1993 | Hediger | 355/212 |
| 5,286,542 | 2/1994 | Susi et al. | 355/212 X |

*Primary Examiner*—Sandra L. Brase
*Attorney, Agent, or Firm*—H. Fleischer; J. E. Beck; R. Zibelli

[57] ABSTRACT

An imaging member having a substrate with a photoconductive layer coated thereon is anisotropic. The anisotropic substrate is stiff along one axis and flexible along another axis. Reinforcing fibers are aligned in the substrate to achieve the relative stiffness.

20 Claims, 2 Drawing Sheets

ANISOTROPIC IMAGING MEMBER

Figure 1:
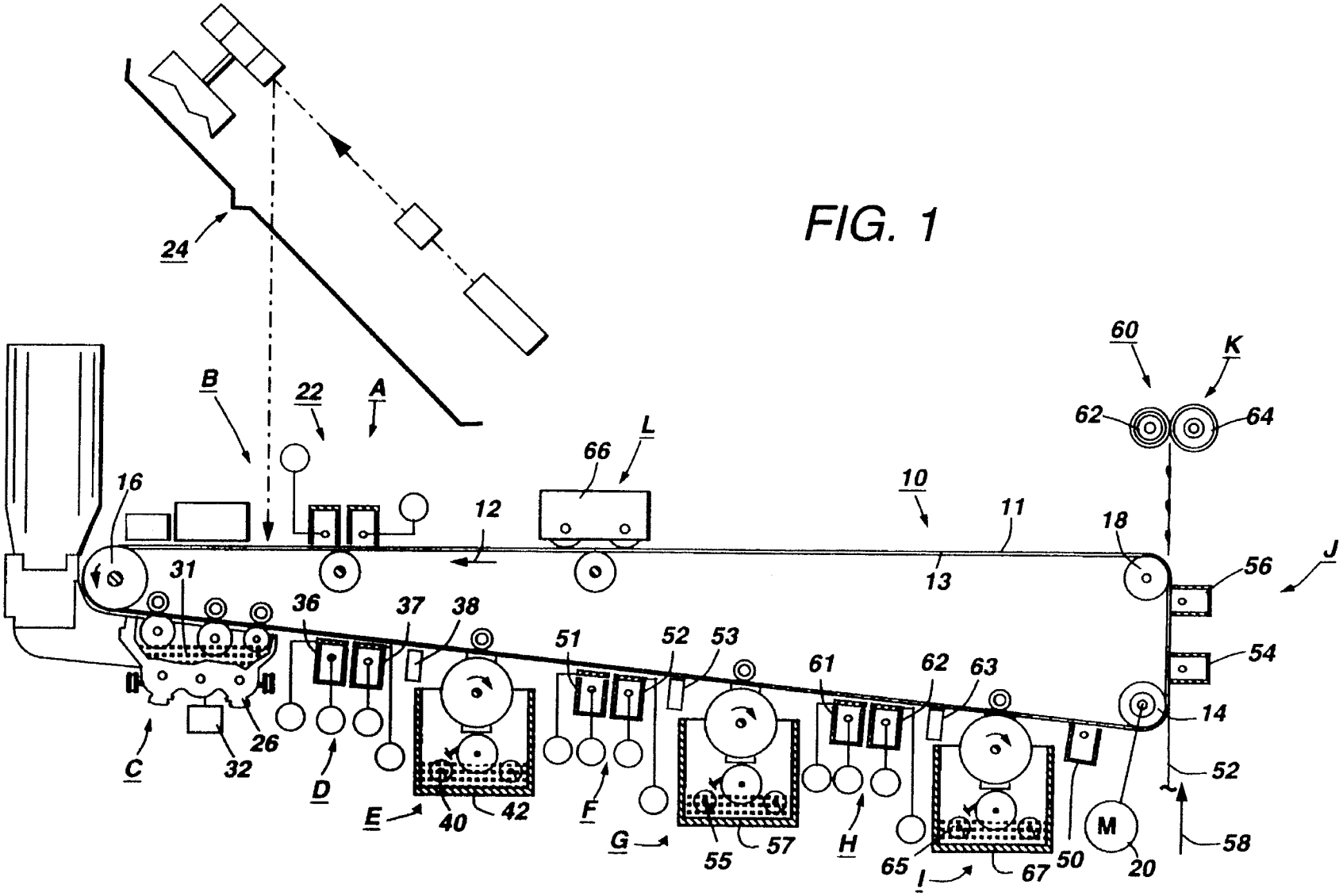

This invention relates to a flexible photoconductive belt. More specifically, the invention relates to an anisotropic, flexible photoconductive belt.

Photoconductive belts are well known in the art. Typical photoconductive belts have a flexible substrate with an electrically conductive surface and a photoconductive layer. The photoconductive layer is applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto the blocking layer and a charge transport layer is thereafter formed on the charge generation layer. Alternatively, the charge generation layer may overlie the charge transport layer. The substrate may be opaque or substantially transparent, and may include a layer of an electrically nonconductive or conductive material, such as an inorganic or an organic composition.

A flexible photoconductive belt is preferred because of its ability to accommodate a large number of processing stations. Generally, however, there is a lack of flatness problem associated with the flexible belt photoreceptor. As the belt is transported around rollers it may wrinkle, pucker, or form ribbed protrusions that interfere with the processing elements that are mounted around the photoreceptor belt, most of which require precise spacing tolerances. Thus, it is desirable to have a relatively flexible photoconductive belt in the direction of movement thereof, and a relatively stiff belt in a direction perpendicular to the direction of movement.

The following disclosure may be relevant to various aspects of the present invention.

U.S. Pat. No. 4,233,383

Patentee: Anthony M. Horgan

Issued: Nov. 11, 1980

The disclosure of the above-identified patent may be briefly summarized as follows U.S. Pat. No. 4,233,383 describes a photoreceptor imaging member. The photoreceptor includes a layer of particulate photoconductive material dispersed in an organic binder overlying a substrate. The photoconductive material comprises trigonal selenium containing a mixture of an alkaline earth metal selenite and an alkaline earth metal carbonate. A plastic which is coated with a thin layer of aluminum, nickel or copper iodine forms the composite structure of a flexible substrate.

In accordance with one aspect of the invention, there is provided an imaging member which includes a substrate and a photoconductive layer. The photoconductive layer is coated on the substrate. The substrate is anisotropic, being stiff along a first axis and flexible along a second axis transverse to the first axis.

In accordance with another aspect of the invention, a printing machine is provided and includes an anisotropic photoconductive member, and a plurality of processing stations. Means are provided for moving the photoconductive member to each of the plurality of processing stations to form a visible image on the photoconductive member.

Figure 2:
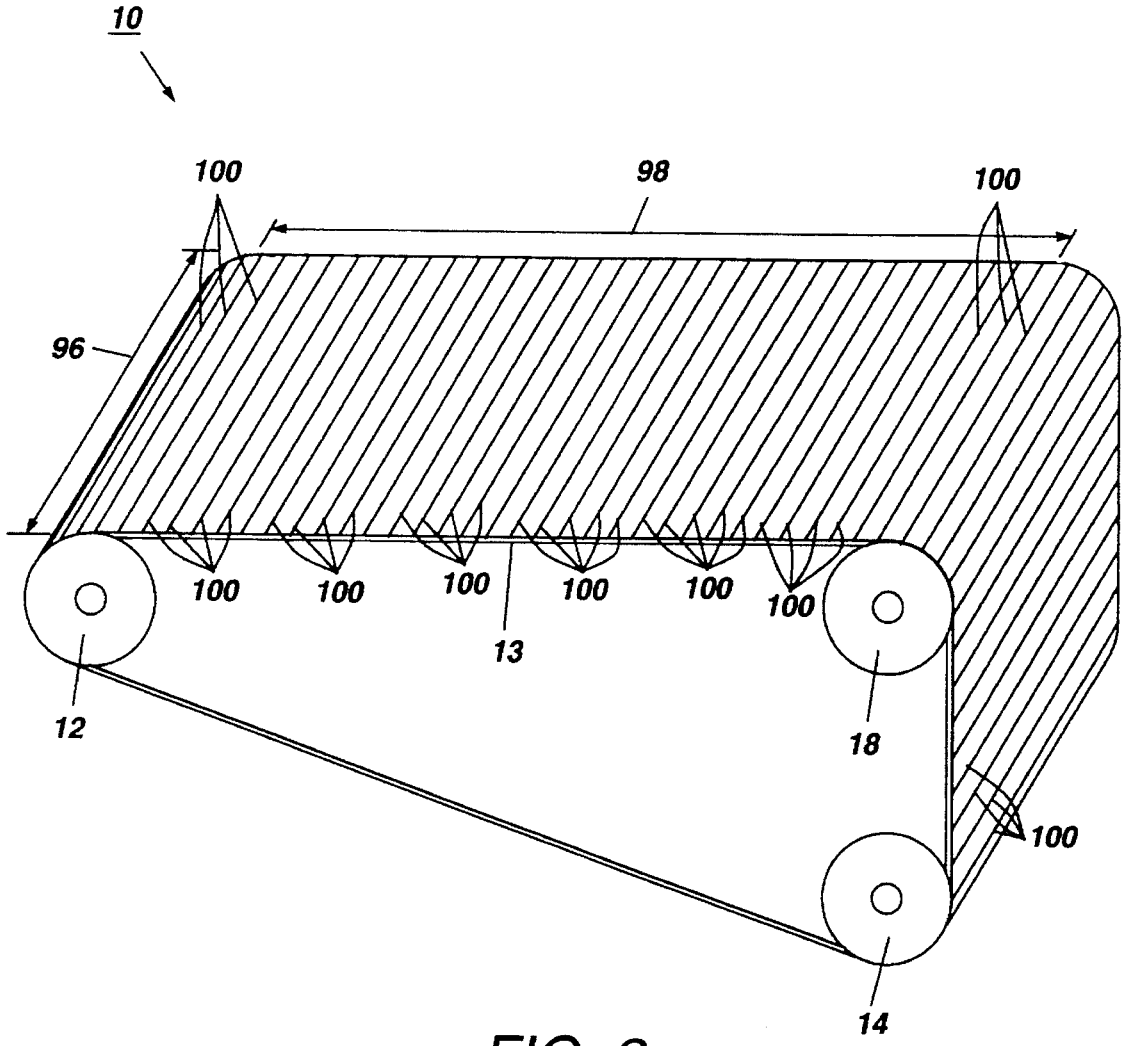

FIG. 1 is an elevational view of an illustrative printing machine incorporating the anisotropic photoconductive belt of the present invention therein; and FIG. 2 is a schematic representation of a module having the photoconductive belt of the FIG. 1 printing machine mounted therein.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. It will become evident from the following discussion that the anisotropic photoconductive belt of the present invention is equally well suited for use in a wide variety of printing machines and is not necessarily limited in its application to the particular embodiment depicted herein.

Turning now to FIG. 1, the printing machine of the present invention employs a photoreceptor 10 in the form of a belt having a photoconductive surface layer 11 on an electroconductive substrate 13. Photoreceptor belt 10 is supported for movement in the direction indicated by arrow 12, for advancing sequentially through the various xerographic process stations. A photoreceptor belt of this type is described in U.S. Pat. No. 4,233,383 issued to Anthony M. Horgan in November, 1980, the relevant portions thereof being incorporated herein. The belt is entrained about a drive roller 14 and two tension rollers 16 and 18. Drive roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of photoconductive surface is advanced through an imaging station B. At imaging station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other exposure devices, for example, a light lens system. After exposure, an electrostatic latent image is recorded on the photoconductive surface.

At a first development station C, a magnetic brush developer unit, indicated generally by the reference numeral 26 advances developer material 31 into contact with the electrostatic latent image. Developer unit 26 has a plurality of magnetic brush roller members. These magnetic brush rollers transport negatively charged black toner material to the latent image for development thereof. Power supply electrically biases developer unit 26.

At recharging station D, a pair of corona recharge devices 36 and 37 are employed for adjusting the voltage level of both the toned and untoned areas on the photoconductive surface to a substantially uniform level. A power supply is coupled to each of the electrodes of corona recharge devices 36 and 37. Recharging devices 36 and 37 substantially eliminate any voltage difference between toned areas and bare untoned areas, as well as to reduce the level of residual charge remaining on the previously toned areas, so that subsequent development of different color toner images is effected across a uniform development field.

A second exposure or imaging device 38 is used to selectively discharge the photoreceptor on toned areas and/or bare areas. This records a second electrostatic latent image on the photoconductive surface. A negatively charged developer material 40, for example, yellow color toner, develops the second electrostatic latent image. The toner is contained in a developer unit 42 disposed at a second developer station E and is transported to the second latent image recorded on the photoconductive surface by a donor roll. A power supply (not shown) electrically biases the developer unit to develop this latent image with the negatively charged yellow toner particles 40.

At a second recharging station F, a pair of corona recharge devices 51 and 52 are employed for adjusting the voltage level of both the toned and untoned areas on the photoconductive surface to a substantially uniform level. A power supply (not shown) is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field.

A third latent image is recorded on the photoconductive surface by ROS 53. This image is developed using a third color toner 55 contained in a developer unit 57 disposed at a third developer station G. An example of a suitable third color toner is magenta. Suitable electrical biasing of the developer unit 57 is provided by a power supply, not shown.

At a third recharging station H, a pair of corona recharge devices 61 and 62 adjust the voltage level of both the toned and untoned areas on the photoconductive surface to a substantially uniform level. A power supply (not shown) is coupled to each of the electrodes of corona recharge devices 61 and 62. The recharging devices 61 and 62 substantially eliminate any voltage difference between toned areas and bare untoned areas as well as to reduce the level of residual charge remaining on the previously toned areas, so that subsequent development of different color toner images is effected across a uniform development field.

A fourth latent image is created using ROS 63. The fourth latent image is formed on both bare areas and previously toned areas of the photoreceptor that are to be developed with the fourth color image. This image is developed, for example, using a cyan color toner 65 contained in developer unit 67 at a fourth developer station I. Suitable electrical biasing of the developer unit 67 is provided by a power supply, not shown.

Developer units 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system.

In order to condition the toner for effective transfer to a substrate, a negative pre-transfer corotron member 50 negatively charges all toner particles to the required negative polarity to ensure proper subsequent transfer.

A sheet of support 52 material is advanced to transfer station J by a sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer corona device 54 which sprays positive ions onto the backside of sheet 52. This attracts the negatively charged toner powder images from the belt 10 to sheet 52. A detack corona device 56 is provided for facilitating stripping of the sheets from belt 10.

After transfer, the sheet continues to move, in the direction of arrow 58, onto a conveyor (not shown) which advances the sheet to fusing station K. Fusing station K includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, not shown, for subsequent removal from the printing machine by the operator.

After the sheet of support material is separated from photoconductive surface of belt 10, the residual toner carried on the photoconductive surface is removed therefrom. The toner is removed at cleaning station L using a cleaning brush structure contained in a housing 66.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

FIG. 1 illustrates an example of a printing machine having the photoconductive belt of the present invention therein to produce a visible image on image color output in a single pass or rotation of the photoreceptor. However, it is understood that the photoconductive belt of the present invention may be used in a multiple pass color image formation process. In a multi-pass system, each successive color image is applied in a subsequent pass or rotation of the photoreceptor. Furthermore, only a single set of charging devices is needed to charge the photoreceptor surface prior to each subsequent color image formation. For purposes of simplicity, both charging devices can be employed for charging the photoreceptor using the split recharge concept as hereinbefore described, prior to the exposure of each color toner latent image. Alternatively, a controller could be used to regulate the charging step so that only a single recharge device is used to charge the photoreceptor surface to the desired voltage level for exposure and development thereon. Also, only a single exposure device is needed to expose the photoreceptor prior to each color image development. Finally, in a multi-pass system, the cleaning station is of the type that is capable of camming away from the surface of the photoreceptor during the image formation process, so that the image is not disturbed prior to image transfer. The transfer station cams away, too, in a multipass process, or at least the sheet is only fed on pass 4.

Referring now to FIG. 2, there is shown schematic representation of a module having the photoconductive belt of the present invention mounted thereon. Substrate 13 is supported on opposite ends of the substrate loop by three rollers 12, 18, and 14. One skilled in the art will appreciate that substrate 13 is the base layer of a flexible photoconductive belt having a substrate and a photoconductive layer. Substrate 13 may be opaque or substantially transparent. Substrate 13 may have a layer of an electrically non-conductive or conductive material such as an inorganic or an organic composition. The thickness of substrate 13 depends on numerous factors, including beam strength and economical considerations. The layer of substrate 13 ranges from about 50 micrometers to about 125 micrometers.

A plurality of long, parallel reinforcing members 100 are embedded in substrate 13. The reinforcing members 100 are made from fibers aligned in a lateral direction, as indicated by arrow 96. The fibers have desirable mechanical properties including a relatively high modulus of elasticity and a high tensile strength. Fibers are preferably selected to have a diameter and volume percentage thereof so as to provide a desired degree of stiffening in the lateral direction shown by arrow 96, while maintaining a desirable degree of flexibility in the process direction indicated by arrow 98. They may, for example, have an average diameter ranging from about 0.05 mils to approximately 2 mils and comprise about 10% to 50% by weight of the reinforcement members. In this way, photoconductive belt 10 is anisotropic. The anisotropic belt is flexible in the process direction and stiff in a direction transverse to the process direction, e.g. perpendicular to the process direction.

The fibers may be monofilament or spun into thread. They may be continuous strands or cut into lengths of less than approximately 0.1 to approximately 0.75 inches. The surface properties of the fibers should be such that they have good adhesion to the bulk material of substrate 13 or alternatively, they should be coated (e.g. with a silane type material) to ensure good adhesion between the fibers and the surrounding material.

If the reinforcing members 100 are a metal, the metal employed may include copper, tin, lead, cobalt, chromium, nickel, silver, gold, titanium, molybdenum, tungsten or alloys such as steel or stainless steel. Alternatively, if the reinforcing members 100 are a synthetic materials, materials such as liquid crystal polymers, graphite, nylon, rayon, polyester, Kevlar (aromatic polyamide obtainable from E. I. dupont de Nemours), Nomax, Peek (polyethoxyether ketones available from ICI) and the like or blends and mixtures thereof can be employed. Preferred synthetic materials include graphite and nylon.

The use of reinforcing members 100 in substrate 13 of FIG. 2 form an anisotropic photoconductive belt. Firstly, the belt is flexible in the process direction, as indicated by arrow 98. Since fibers 100 allow substrate 13 to maintain flexibility, the photoconductive belt will endure many rotations around belt module rollers 16, 18, and 14 without cracking due to stress fatigue. Secondly, the anisotropic photoconductive belt is stiff in the lateral direction perpendicular to the process direction as indicated by arrow 96. The lateral stiffness improves the flatness of the belt photoreceptor as it tracks around the belt module rollers.

Another benefit of the present invention includes belt edge damage reduction from interactions with edge guides. Belt edge damage is reduced by the reinforcing fibers in the substrate layer increasing the buckling force that the belt can sustain. Traditionally, belt edge damage has been a major cause of belt replacement in printing machines utilizing belt architectures. Thus, another benefit derived from the present invention is a reduction in the number of customer service calls requiring photoconductive belt replacement.

In recapitulation, the present invention is directed to an anisotropic photoconductive belt that is relatively flexible in one direction while being relatively stiff in an another direction. The belt has reinforcing fibers in the substrate thereof. These fibers are aligned to achieve the desired degree of flexibility and stiffness.

It is, therefore, evident that there has been provided, in accordance with the present invention, an anisotropic photoconductor belt that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall are within the spirit and broad scope of the appended claims.

I claim:

1. An imaging member, including:

a substrate; and a photoconductive layer coated on said substrate, said substrate being anisotropic so as to be stiff along a first axis and flexible along a second axis transverse to the first axis.

2. An imaging member according to claim 1, wherein said substrate includes a plurality of reinforcing fibers extending along the first axis.

3. An imaging member according to claim 2, wherein said reinforcing fibers include a metal.

4. An imaging member according to claim 2, wherein said reinforcing fibers include a synthetic material.

5. An imaging member according to claim 2, wherein said reinforcing fibers are monofilament threads.

6. An imaging member according to claim 2, wherein said substrate includes a belt.

7. An imaging member according to claim 2, wherein the first axis is substantially perpendicular to the second axis.

8. A printing machine, including:

a mechanically anisotropic photoconductive member;

a plurality of processing stations; and means for moving said photoconductive member to each of said plurality of processing stations to form a visible image on said photoconductive member.

9. A printing machine, including:

a photoconductive member comprising a substrate, and a photoconductive layer coated on said substrate, said substrate being stiff in a direction substantially transfers to the process direction and flexible in a direction substantially parallel to the process direction;

a plurality of processing stations; and means for moving said photoconductive member to each of said plurality of processing stations to form a visible image on said photoconductive member.

10. A printing machine according to claim 9, wherein said substrate includes a plurality of reinforcing fibers extending in the direction substantially transverse to the process direction.

11. A printing machine according to claim 9, wherein said reinforcing fibers include a metal.

12. A printing machine according to claim 9, wherein said reinforcing fibers include a synthetic material.

13. A printing machine according to claim 9, wherein said reinforcing fibers are monofilament threads.

14. A printing machine according to claim 9, wherein said substrate includes a belt.

15. A printing machine according to claim 14, wherein the direction substantially transverse to the process direction is substantially perpendicular to the process direction.

16. A printing machine according to claim 9, wherein said plurality of processing stations form a multicolor visible image on said photoconductive layer.

17. A printing machine according to claim 16, wherein said photoconductive member moves in a recirculating path.

18. A printing machine according to claim 17, further including means for transferring the multicolor visible image from said photoconductive layer to a sheet of support material.

19. A printing machine according to claim 18, wherein said transferring means transfers the multicolor visible image after said photoconductive member moves through the recirculating path a single cycle.

20. A printing machine according to claim 18, wherein said transferring means transfers the multicolor visible image after said photoconductive member moves through the recirculating path a plurality of cycles.

* * * * *